US005456627A

United States Patent [19]

Jackson et al.

[11] Patent Number: 5,456,627

[45] Date of Patent: Oct. 10, 1995

[54] CONDITIONER FOR A POLISHING PAD AND METHOD THEREFOR

[75] Inventors: Paul D. Jackson, Scottsdale; Stephen C. Schultz, Gilbert; James E. Sanford, Mesa; Glen Ong, Tempe; Richard B. Rice, Chandler; Parag S. Modi, Phoenix; John G. Baca, Tempe, all of Ariz.

[73] Assignee: Westech Systems, Inc., Phoenix, Ariz.

[21] Appl. No.: 148,906

[22] Filed: Dec. 20, 1993

[51] Int. Cl.[6] ..... B24B 49/18; B24B 53/02

[52] U.S. Cl. ..... 451/11; 451/56; 451/57; 451/63; 451/67

[58] Field of Search ..... 51/262 A, 325, 51/165.71, 165.77, 165.8, 5 D, 165.74; 451/65, 72, 56, 287, 288, 289, 290, 1, 5, 24, 26, 57, 63, 67

[56] References Cited

U.S. PATENT DOCUMENTS

| | | | |
|---|---|---|---|
| 3,903,651 | 9/1975 | Suzuki et al. | 51/5 D |
| 4,813,830 | 3/1989 | Genequand et al. | 409/174 |
| 4,873,792 | 10/1989 | Linke et al. | 51/165.8 |
| 4,884,941 | 12/1989 | Kazerooni | 414/744.5 |
| 5,003,730 | 4/1991 | Halvorsen | 51/325 |
| 5,138,799 | 8/1992 | Buckingham et al. | 51/165 R |
| 5,154,021 | 10/1992 | Bombardier et al. | 51/262 A |
| 5,216,843 | 6/1993 | Breivogel et al. | 51/131.1 |
| 5,245,796 | 9/1993 | Miller | 51/283 R |
| 5,291,693 | 3/1994 | Nguyen | 51/283 R |

FOREIGN PATENT DOCUMENTS

| | | | |
|---|---|---|---|
| 0149158 | 9/1982 | Japan | 51/5 D |

*Primary Examiner*—Jack W. Lavinder
*Attorney, Agent, or Firm*—Harry M. Weiss; Jeffrey D. Moy

[57] ABSTRACT

An axially rotating circular polishing pad is conditioned by a rotating end effector that has an abrasion disc in contact with a polishing surface of the pad. The end effector moves along a radius of the polishing pad surface at a velocity that varies to compensate for locations on the polishing pad surface having linear velocities that are directly related to their respective radii. A desired contact force is maintained between the end effector and the polishing pad surface.

16 Claims, 2 Drawing Sheets

CONDITIONER FOR A POLISHING PAD AND METHOD THEREFOR

BACKGROUND OF THE INVENTION

1. Field of Invention

This invention is in the field of methods and apparatus for semiconductor processing and, more particularly, relates to a method and apparatus for conditioning a pad used for polishing a silicon wafer.

2. Description of Prior Art

A silicon wafer is typically fabricated as a disc having a diameter in a range of 100 to 200 millimeters and a thickness in a range of 16 to 20 mils. The wafer is thereafter subjected to a masking process in preparation for using it, for example, in a production of integrated circuits.

The masking process causes a multiplicity of undesired irregularities on a device surface of the wafer. It should be appreciated that the size of the irregularities is typically on the order of one micron. However, it is of critical importance that the irregularities be removed.

The removal of the irregularities is accomplished through the use of a polishing pad having a circular polishing surface. The diameter of the surface of the polishing pad is up to several times as large as the diameter of the wafer.

The device surface is made to bear against the polishing pad surface near the edge thereof. The wafer and the pad both axially rotate, causing the polishing pad surface to rub against the device surface and thereby polish it. The polishing is enhanced by a process that includes dispersing a slurry, typically comprised of a colloidal silica, on the polishing pad surface. This enhanced polishing process, known as chemical mechanical planerization (CMP), is usually effective in removing the irregularities.

The slurry and the removed irregularities undesirably impregnate the pad, causing the polishing pad surface to become smooth and irregular, in a manner similar to an automobile polishing cloth becoming smooth and irregular after extensive use. The impregnated pad may be conditioned for polishing by using what is known as an end effector which rotates as it bears against the polishing pad surface.

The end effector is usually connected to one end of a cantilever that is rotatable about the axis of a mounting arrangement adjacent to the pad. The mounting arrangement comprises the other end of the cantilever. The end effector moves in an arcuate path in contact with the polishing pad in a manner similar to a phonograph needle moving over a phonograph record mounted on the turntable of a record player.

A disadvantage of the arcuate path is that when the polishing pad is axially rotated, locations on the polishing pad surface have linear velocities that are directly related to their respective radii. Hence, the respective linear velocities of the locations are non-uniform. Therefore, the conditioning is non-uniform, thereby causing the polishing to be correspondingly non-uniform.

Heretofore, simple and inexpensive apparatus and a method for uniformly conditioning the polishing surface have been unknown.

SUMMARY OF THE INVENTION

An object of the present invention is to provide an improved apparatus and method for uniformly conditioning a polishing surface of a pad used to remove undesired irregularities from a silicon wafer.

BRIEF DESCRIPTION OF A PREFERRED EMBODIMENT

According to one aspect of the present invention, an end effector is moved radially on a polishing surface of a circular pad.

According to another aspect of the present invention, an end effector is coupled to a drive mechanism included in a cantilever that is fixedly maintained over a polishing surface; the drive mechanism causes the end effector to move along a radius of a circle defined by the polishing surface as it is maintained against the polishing surface.

An axially rotatable end effector of a conditioner of the present invention moves radially along the polishing surface of an axially rotating circular pad. A computer may be programmed to cause the radial movement of the end effector to be at a velocity that varies to compensate for locations on the polishing surface having linear velocities that are directly related to their respective radii.

Other objects, features and advantages of the present invention will be apparent from the following description of the preferred embodiment of the invention as illustrated in the accompanying drawing.

DESCRIPTION OF THE PREFERRED EMBODIMENT

Figure 1:
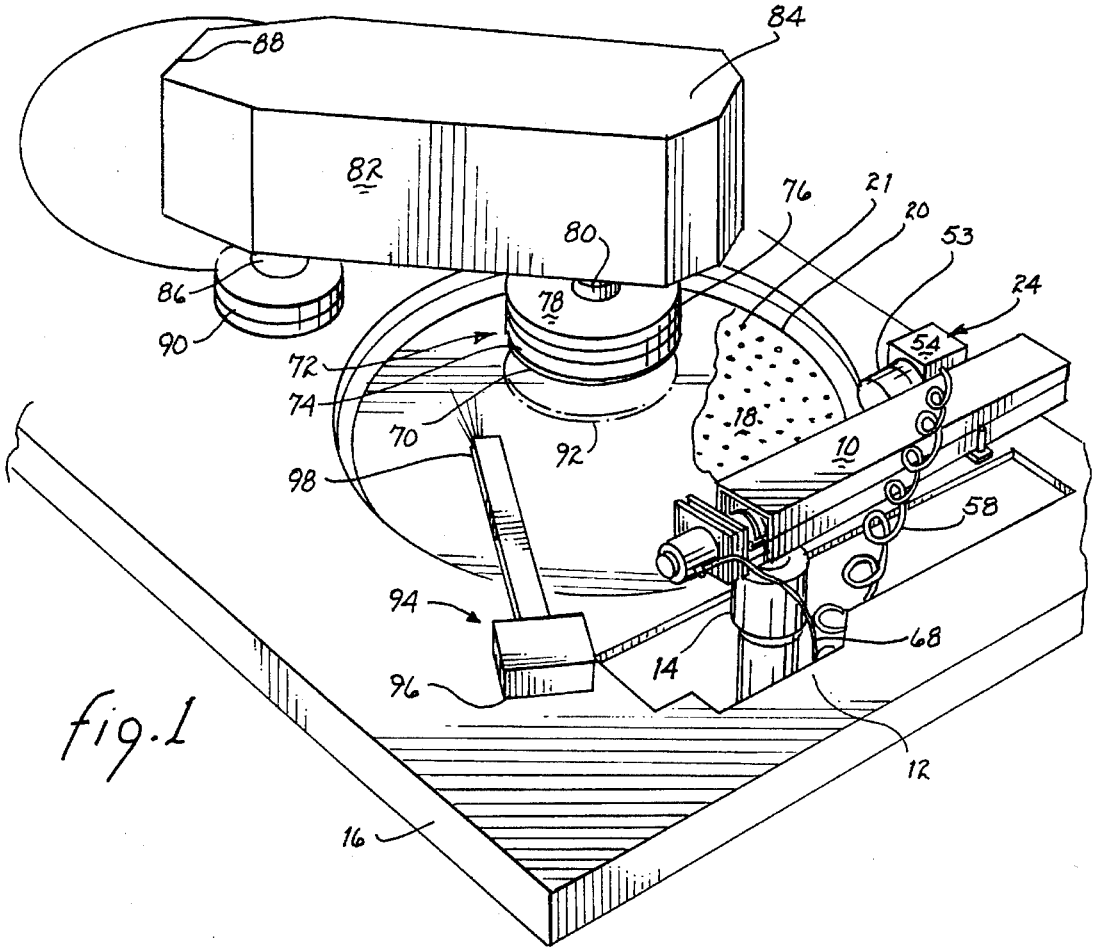
FIG. 1 is a perspective view, with parts broken away, of the preferred embodiment of the present invention.
Figure 2:
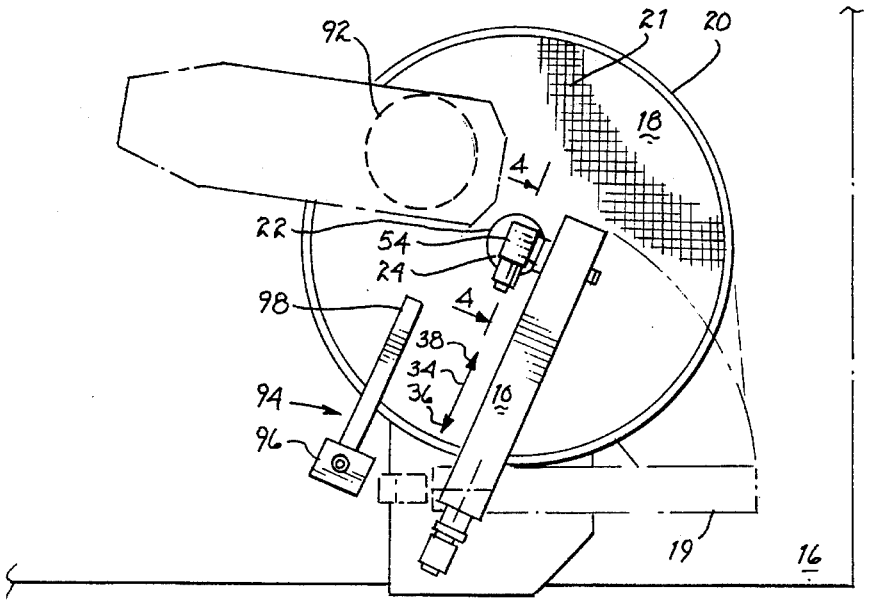
FIG. 2 is a plan view, with parts broken away, of the embodiment of FIG. 1.
Figure 3:
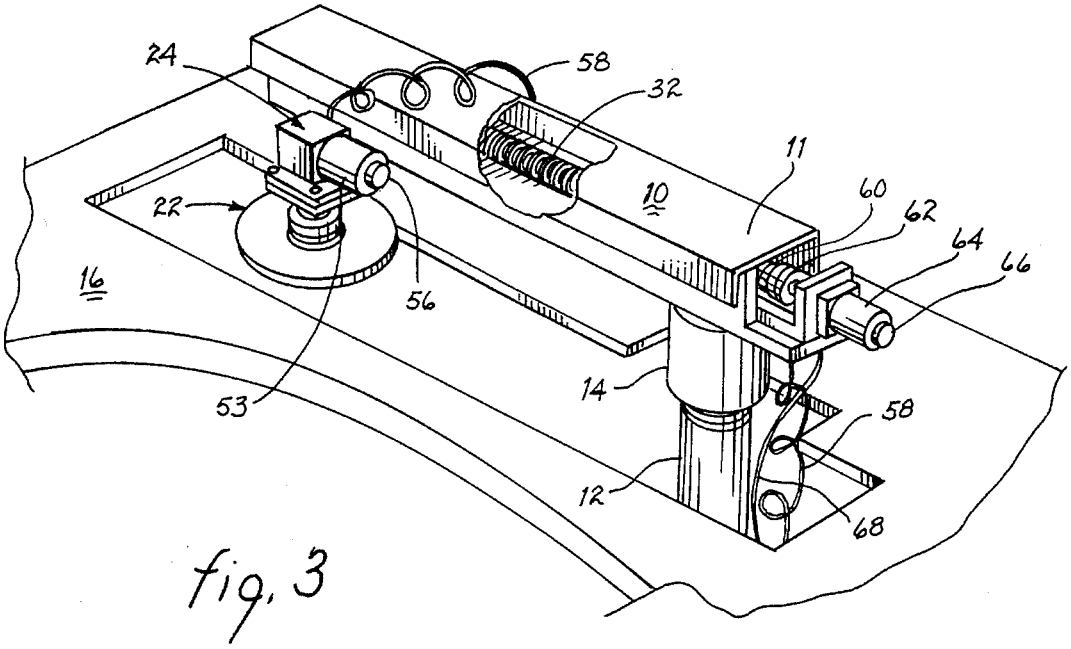
FIG. 3 is a perspective view, with parts broken away, of a cantilever that carries an end effector shown in FIG. 2.

As shown in FIGS. 1–3, a cantilever arm 10 is fixedly connected near an end 11 thereof to a cylinder 12 via a fitting 14. Additionally, cylinder 12 extends to the interior of an enclosure 16.

In this embodiment, axial rotation of cylinder 12 is selected by programming a computer that is coupled to a drive motor (not shown) within enclosure 16.

Accordingly, arm 10 may be rotated about an axis 17 of cylinder 12 to extend over a polishing pad surface 18 of an axially rotating circular pad 20 (FIGS. 1 and 2) that typically has a multiplicity of holes 21 therethrough. When arm 10 does not extend over polishing pad surface 18, it is usually maintained in a rest position shown by broken lines 19.

A vertical position of cylinder 12 along its axis is similarly selected by programming the computer, whereby a displacement of arm 10 from polishing pad surface 18 is correspondingly selected when arm 10 extends over polishing pad surface 18. In other words, arm 10 is analogous to an arm of a phonograph which may be rotated, raised and lowered over a turntable. Positioning of cylinder 12 is via a dc servomotor (not shown) similar to dc servomotors that are shown hereinafter.

An end effector 22 is connected via a motor assembly 24 to arm 10. End effectors are well known to those skilled in the art.

When there is an axial movement of cylinder 12 in one direction, end effector 22 moves parallel to a line 26 (FIG. 4) in the direction of an arrowhead 28, whereby end effector 22 may be brought into contact with polishing pad surface 18. When there is an axial movement of cylinder 12 in the opposite direction, end effector 22 moves parallel to line 26 in the direction of an arrowhead 30 whereby end effector 22 may be withdrawn from contact with polishing pad surface 18. As explained hereinafter, end effector 22 is in contact with surface 18 and rotates about its axis when pad 20 is being conditioned.

Cylinder 12 is coupled through a mechanical coupler 23 to a load transducer 25 (FIG. 1). Axial motion of cylinder 12 causes a force to be applied to load transducer 25 substantially the same as a contact force between end effector 22 and polishing pad surface 18. Load transducer 25 is of a type that generates a signal having an amplitude proportional to the applied force. In other words, load transducer 25 substantially senses the contact force and generates a signal proportional thereto.

Figure 6:
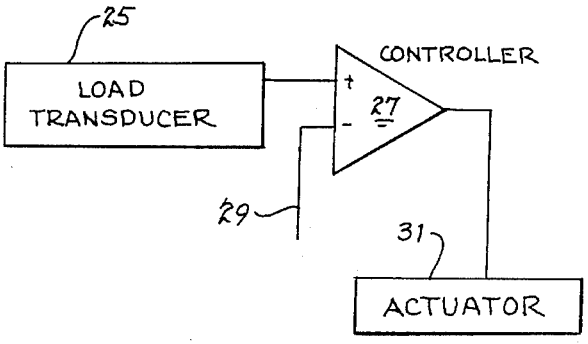
FIG. 6 is a schematic block diagram of a constant contact force circuit in the embodiment of FIG. 1.

As shown in FIG. 6, the computer provides a signal proportional to a desired contact force to a differential input of a high gain controller 27 through a signal line 29. The differential input is additionally connected to load transducer 25. The output of controller 27 is connected to a high gain actuator 31 which drives cylinder 12.

Since controller 27 has a high gain, actuator 31 is operable to move end effector 22, via cylinder 12, in a direction that causes the output of load transducer 25 to substantially equal the desired contact force signal. Accordingly, the computer is operable to maintain a desired contact force between end effector 22 and polishing pad surface 18.

Motor assembly 24 is connected to a lead screw 32 (FIG. 3) of arm 10. When lead screw 32 is rotated in one direction, end effector 22 and assembly 24 move along a line 34 in the direction of an arrowhead 36 (FIG. 2). When lead screw 32 is rotated in the opposite direction, end effector 22 and assembly 24 move along line 34 in the direction of an arrowhead 38. According to the present invention, arm 10 is rotatable to cause line 34 to be along a radius of pad 20, thereby causing end effector 22 to move radially across polishing pad surface 18 in response to a rotation of lead screw 32. As explained hereinafter, the radial movement is preferably at a velocity that varies to compensate for locations on polishing pad surface 18 having linear velocities that are directly related to their respective radii.

Figure 4:
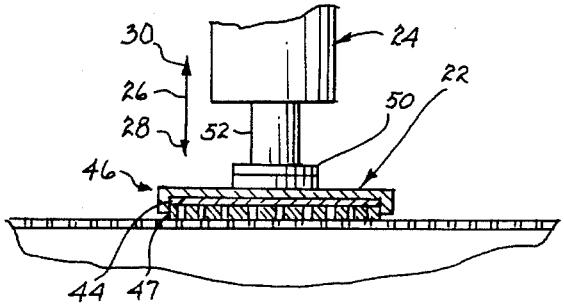
FIG. 4 is a sectional view of a side elevation of the end effector shown in FIG. 2 taken along the line 4—4.
Figure 5:
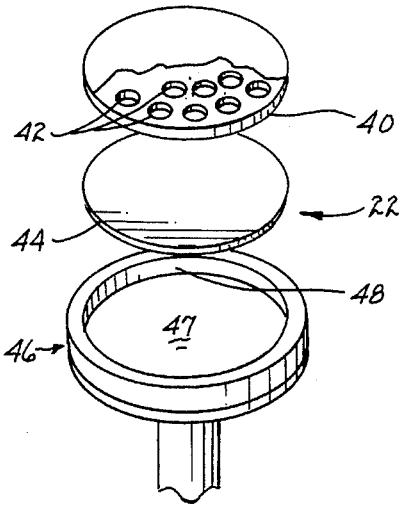
FIG. 5 is an exploded view of the end effector shown in FIG. 2.

As shown in FIGS. 4 and 5, end effector 22 is comprised of an abrasion disc 40 having a multiplicity of holes 42 therethrough. Disc 40 is typically made from nickel plated, diamond impregnated carbon steel which is a magnetic material.

Through magnetic attraction, disc 40 is carried on one surface of a disc shaped magnet 44 that has approximately the same diameter as disc 40. The other surface of magnet 44 has a coating of glue thereon.

Magnet 44 is disposed within a hollow, cylindrical non-magnetic retainer 46 of end effector 22 with the glue surface upon a closed end 47 of retainer 46. In other words, magnet 44 is glued to end 47, whereby magnet 44 is fixedly connected within retainer 46.

An inside wall 48 of retainer 46 maintains disc 40 against lateral movement. Additionally, a portion 49 (FIG. 4) of disc 42 extends outside of retainer 46 thereby preventing retainer 46 from contacting surface 18 while it contacts disc 40.

Retainer 46 is connected via a flexure coupling 50 to an output shaft 52 of assembly 24. Because flexure 50 is used, effects of mechanical misalignment between end effector 22 and motor assembly 24 are reduced. Flexure couplings are well known to those skilled in the art.

Assembly 24 includes a dc servomotor 53 (FIG. 3) that has its shaft connected to a gear of a gearbox 54. Shaft 52 extends from gear box 54. Because of gearbox 54, when the shaft of motor 53 rotates at one rate, end effector 52 rotates at a reduced rate. Motor 53 is of a type well known to those skilled in the art.

Assembly 24 additionally includes a resolver 56 that has its shaft coaxially connected to the shaft of motor 53. Resolver 56 provides an analog signal representation of the sine and cosine of an angle that a point on the shaft of motor 53 subtends with a datum plane that contains the axis of the shaft of motor 53. Resolver 56 is of a type well known to those skilled in the art.

Motor 53 and resolver 56 are connected through a plurality of signal lines of a cable 58 to components within the interior of enclosure 16 to form an end effector velocity servo. The end effector velocity servo is connected to the computer whereby the angular velocity of end effector 22 is selected by programming the computer. Velocity servos are well known to those skilled in the art.

Lead screw 32, referred to hereinbefore, has an end 60 connected via a flexure coupling 62 to the shaft of a dc servomotor 64 that is fixedly mounted on end 11. Flexure 62 and motor 64 are respectively similar to flexure 50 and motor 53 described hereinbefore.

A resolver 66, similar to resolver 56, has its shaft coaxially connected to the shaft of motor 64. Resolver 66 provides an analog signal representation of the sine and cosine of an angle that a point on the shaft of motor 64 subtends with a datum plane that contains the axis of the shaft of motor 64.

Resolver 66 and motor 64 are connected through a plurality of signal lines of a cable 68 (FIGS. 1 and 3) to components within the interior of enclosure 16 to form a radial movement velocity servo. The radial movement velocity servo is connected to the computer, whereby the radial velocity of end effector 22 is selected by programming the computer. Preferably, the radial velocity is selected to vary in a manner that compensates for locations on polishing pad surface 18 having linear velocities that are directly related to their respective radii.

As explained hereinafter, a wafer 70 (FIG. 1) is maintained in a vacuum chuck 72 in an abutting relationship with one side of a carrier ring 74 thereof. Vacuum chuck 72 includes an annular carrier 76 that abuts the other side of carrier ring 74 and is coaxial therewith. Carrier 76 is covered by a cover 78.

Vacuum chuck 72 is coaxially connected to one end of a hollow cylinder 80. When cylinder 80 is axially rotated, vacuum chuck 72 is correspondingly rotated.

Cylinder 80 extends to the interior of a cantilever arm 82 near a proximal end 84 thereof to form a passageway between the interior of vacuum chuck 72 and the interior of arm 82. A hollow cylinder 86 has one end fixedly connected to arm 82 near a distal end 88 thereof. Cylinder 86 slidably extends through a bushing 90 to the interior of enclosure 16 to form a passageway between the interior of enclosure 16 and the interior of arm 82.

When cylinder 86 is axially rotated, Vacuum chuck 72 rotates about the axis of cylinder 86. Within enclosure 16, cylinder 86 is connected to a drive mechanism that is coupled to the computer. Axial rotation of cylinder 86 is selected by programming the computer.

A position of cylinder 86 along its axis is similarly selected by programming the computer, whereby a displacement of wafer 70 from surface 18 is correspondingly selected when arm 82 extends over surface 18. In this embodiment, the axial rotation of cylinder 86 and the position along its axis is selected to bring wafer 70 to a location indicated by broken line 92 when a device surface of wafer 70 is to be polished. It should be understood that the conditioning of pad 20 may alternatively take place while the device surface of wafer 70 is being polished or while it is not being polished.

Within enclosure 16, cylinder 86 is connected to a vacuum pump that reduces air pressure within vacuum chuck 72. The reduced air pressure within vacuum chuck 72 fixedly retains wafer 70 in contact with carrier ring 74.

Polishing of the device surface of wafer 70 is enhanced by dispensing a colloidal silica slurry upon polishing pad surface 18 from a dispenser 94 that has an end 96 connected to a slurry tank and a slurry pump (not shown) within enclosure 16. The pump is operable to cause a flow of slurry from the tank through a nozzle 98 of dispenser 94 onto polishing pad surface 18.

The description of the preferred embodiment given herein is given by way of example. Changes in form and detail may be made by those skilled in the art without departing from the spirit and scope of the present invention as defined by the following claims.

What is claimed is:

1. An apparatus for conditioning a polishing surface of a pad that is rotatable about a pad axis, comprising:

end effector means for contacting said polishing surface;

arm means coupled to said end effector means for moving said end effector means along a radial line passing through said pad axis; and programming means coupled to said arm means for moving said end effector means across said polishing surface of said pad at a programmable rate to obtain uniform conditioning of said polishing surface of said pad.

2. An apparatus according to claim 1 further comprising:

abrasive disc means coupled to said end effector means for contacting said polishing surface of said pad;

said abrasive disc means rotating about a disc axis and simultaneously moving with said end effector means along said radial line passing through said pad axis.

3. An apparatus according to claim 2, said programming means further comprising rate means for controlling the rate of movement along a radial line of said end effector so that the linear velocity of said abrasion disc relative to said polishing surface of said pad remains constant to produce uniform conditioning.

4. An apparatus according to claim 3, further comprising:

force means coupled to said end effector means for programmably controlling the contact force applied by said abrasion disc on said polishing surface of said pad.

5. An apparatus according to claim 4, said force means further comprising:

controller means for providing a high gain amplifier having a differential input and an output;

computer means coupled to said differential input for generating a signal proportional to a programmed level of contact force;

transducer means coupled to said differential input for generating a signal proportional to the actual level of contact force applied by said abrasion disc on said polishing surface of said pad; and actuator means coupled to said output of said controller means and operably coupled to said end effector means for moving said end effector means in the direction required to cause said actual level of contact force to be equal to programmed level of contact force.

6. An apparatus according to claim 1, said arm means further comprising:

lead screw means coupled to said end effector means for providing transverse movement to said end effector means; and rotational means for axially rotating said lead screw means.

7. An apparatus according to claim 6, said arm means further comprising:

cantilever arm means coupled to a mounting end and containing said lead screw means and said rotational means for rotating around said mounting end to position said end effector means to allow movement along a radial line passing through said pad axis.

8. An apparatus according to claim 6, said rotational means further comprising a servomotor coupled to said lead screw means and a resolver coupled to said servomotor.

9. A method for conditioning a polishing surface of a pad that is rotatable about a pad axis, comprising the steps of:

providing end effector means for contacting said polishing surface;

providing arm means coupled to said end effector means for moving said end effector means along a radial line passing through said pad axis; and providing programming means coupled to said arm means for moving said end effector means across said polishing surface of said pad at a programmable rate to obtain uniform conditioning of said polishing surface of said pad.

10. The method according to claim 9 further comprising the step of:

providing abrasive disc means coupled to said end effector means for contacting said polishing surface of said pad;

said abrasive disc means rotating about a disc axis and simultaneously moving with said end effector means along said radial line passing through said pad axis.

11. The method according to claim 10, said programming means further comprising rate means for controlling the rate of movement along a radial line of said end effector so that the linear velocity of said abrasion disc relative to said polishing surface of said pad remains constant to produce uniform conditioning.

12. The method according to claim 11, further comprising the step of:

providing force means coupled to said end effector means for programmably controlling the contact force applied by said abrasion disc on said polishing surface of said pad.

13. The method according to claim 12, said step of providing force means further comprising the steps of:

providing controller means for providing a high gain amplifier having a differential input and an output;

providing computer means coupled to said differential input for generating a signal proportional to a programmed level of contact force;

providing transducer means coupled to said differential input for generating a signal proportional to the actual level of contact force applied by said abrasion disc on said polishing surface of said pad; and providing actuator means coupled to said output of said controller means and operably coupled to said end effector means for moving said end effector means in the direction required to cause said actual level of contact force to be equal to said programmed level of contact force.

14. The method according to claim 9, said arm means further comprising:

lead screw means coupled to said end effector means for providing transverse movement to said end effector means; and rotational means for axially rotating said lead screw means.

15. The method according to claim 14, said arm means further comprising:

cantilever arm means coupled to a mounting end and containing said lead screw means and said rotational means for rotating around said mounting end to position said end effector means to allow movement along a radial line passing through said pad axis.

16. The method according to claim 15, said rotational means further comprising a servomotor coupled to said lead screw means and a resolver coupled to said servomotor.

* * * * *